US008225962B2

(12) United States Patent
Rossignol

(10) Patent No.: US 8,225,962 B2
(45) Date of Patent: Jul. 24, 2012

(54) MULTIPLE-PUMP DISPENSER

(75) Inventor: Eric Rossignol, Chalon sur Saone (FR)

(73) Assignee: Rexam Dispensing SMT S.A. (FR)

( * ) Notice: Subject to any disclaimer, the term of this patent is extended or adjusted under 35 U.S.C. 154(b) by 817 days.

(21) Appl. No.: 11/763,284

(22) Filed: Jun. 14, 2007

(65) Prior Publication Data

US 2007/0289999 A1 Dec. 20, 2007

(30) Foreign Application Priority Data

Jun. 14, 2006 (EP) ..... 06290971

(51) Int. Cl.
*B67D 5/52* (2006.01)

(52) U.S. Cl. ..... 222/137; 222/135

(58) Field of Classification Search ..... 222/135, 222/137

See application file for complete search history.

(56) References Cited

U.S. PATENT DOCUMENTS

| | | | | |
|---|---|---|---|---|
| 4,595,127 | A * | 6/1986 | Stoody | 222/135 |
| 5,509,551 | A * | 4/1996 | Terrell, II | 215/229 |
| 6,082,588 | A * | 7/2000 | Markey et al. | 222/137 |
| 6,729,501 | B2 * | 5/2004 | Peterson | 222/135 |
| 2004/0129727 | A1 | 7/2004 | Foster et al. | 222/137 |

FOREIGN PATENT DOCUMENTS

| | | |
|---|---|---|
| DE | 203 04 731 | 6/2003 |
| EP | 0 753 353 | 1/1997 |
| WO | 98/30332 | 7/1998 |
| WO | 03/106045 | 12/2003 |

OTHER PUBLICATIONS

European Search Report, Nov. 21, 2006, 5 pages.

* cited by examiner

*Primary Examiner* — Kevin P Shaver
*Assistant Examiner* — Donnell Long
(74) *Attorney, Agent, or Firm* — St. Onge Steward Johnston & Reens LLC

(57) ABSTRACT

A liquid product dispenser including a container equipped with several independent compartments, each of which is associated with a pump including a body which is blocked, at the bottom, by a suction valve and, at the top, by an applicator and/or an exhaust valve and which contains a piston mechanism cooperating with an elastic return system, characterized in that the pump bodies are solidly attached to one another in the form of a single shrunk-on ring by a linking spacer which also watertightly covers the container compartments.

17 Claims, 4 Drawing Sheets

MULTIPLE-PUMP DISPENSER

CROSS-REFERENCE TO RELATED APPLICATIONS

The present application claims priority of European patent application No. 06 290 971.8 filed on Jun. 14, 2006, the content of which is incorporated herein by reference.

FIELD OF THE INVENTION

The present invention relates to a multiple-pump dispenser.

BACKGROUND OF THE INVENTION

Multiple-pump dispensers are generally used to dispense liquid cosmetic or pharmaceutical products comprising several components.

These components are packaged independently in separate compartments of the same container.

This configuration fulfills a constraint of having to isolate components due to chemical or biological incompatibility.

Each component is taken from its compartment and dispensed by a dedicated, independent pump.

These pumps usually consist of a body, which is blocked, at the bottom, by a suction valve and, at the top, by an applicator and/or an exhaust valve, and which contains a piston mechanism cooperating with an elastic return system.

When joint ejection of the components is required, the different mechanisms are activated simultaneously and the mix of components enters the pump exhaust area.

In such a configuration, the pumps are not necessarily identical. Their capacity as well as their mechanisms can be chosen according to the components to be combined in order to obtain the desired properties and, in particular, a specific final composition of the dispensed product.

Such dispensers are therefore expensive due, on the one hand, to their complex structure which is adapted to integrate heavy equipment as sampling means and, on the other hand, to the cost of the pumps themselves.

The present invention aims to solve these technical problems by providing a simplified structure that uses a single constituent or functional means and, in particular, by using the same essential mechanical elements for all pumps.

SUMMARY OF THE INVENTION

This aim is achieved, according to the invention, by a specific dispenser characterised in that said pump bodies are solidly attached to one another in the form of a single shrunk-on ring by a linking spacer, which also covers said container compartments in a watertight manner.

According to one advantageous characteristic, said shrunk-on ring comprises at least one element for watertight connection with the wall of the compartments.

According to another characteristic, said applicators are fixed under a cover forming at least one actuator which cooperates with the return system.

According to yet another characteristic, the top side of said applicators comprises a radial groove opening onto the outside via a discharge passage.

Said groove is preferably closed at the top by the bottom side of said cover.

According to one specific variation, said applicators have radial shoulders supported by the return system.

Said shoulders advantageously support a centreing finger of the return system.

Said shoulders are preferably connected in a central manner forming a single cylinder.

According to another specific variation, said compartments are cylindrical and arranged within one another in a nested manner.

Furthermore, it is provided for said pump bodies to be made from a single piece with intake tubes immersed in said container compartments.

According to another variation, said spacer has a central sleeve for blocking the single return system.

According to a first embodiment of the pumps, said applicators comprise a lateral skirt slidingly covering a piston, consisting of an inner jacket anchored in the body of the pump and supporting the suction valve.

In this case, said jacket has an axial rod passing through it, the upper end of which forms the valve of the exhaust valve.

According to another embodiment, said piston consists of a hollow rod covered, at the top, by said applicator and coupled, at the bottom, with an inverted cup.

In this other case, said rod is mobile in relation to said cup so as to open the exhaust valve arranged at the bottom end of said rod.

According to a preferred variation of this latter embodiment, said pumps are blocked in a watertight manner by bushes inserted in the bodies around the hollow rods, which are solidly attached to one another by means of a plate.

The dispenser according to the invention has a straightforward, inexpensive structure adapted for packaging and simultaneously or consecutively supplying different components of a single product or several products.

This structure provides a common platform with functional elements which can be slaved to multiple identical or different sampling means.

The presence of a single return system which is not in contact with the product components provides good preservation conditions.

BRIEF DESCRIPTION OF THE DRAWINGS

The invention will be understood better after reading the detailed description made below in reference to the drawings, wherein.

DETAILED DESCRIPTION OF THE INVENTION

Figure 2:
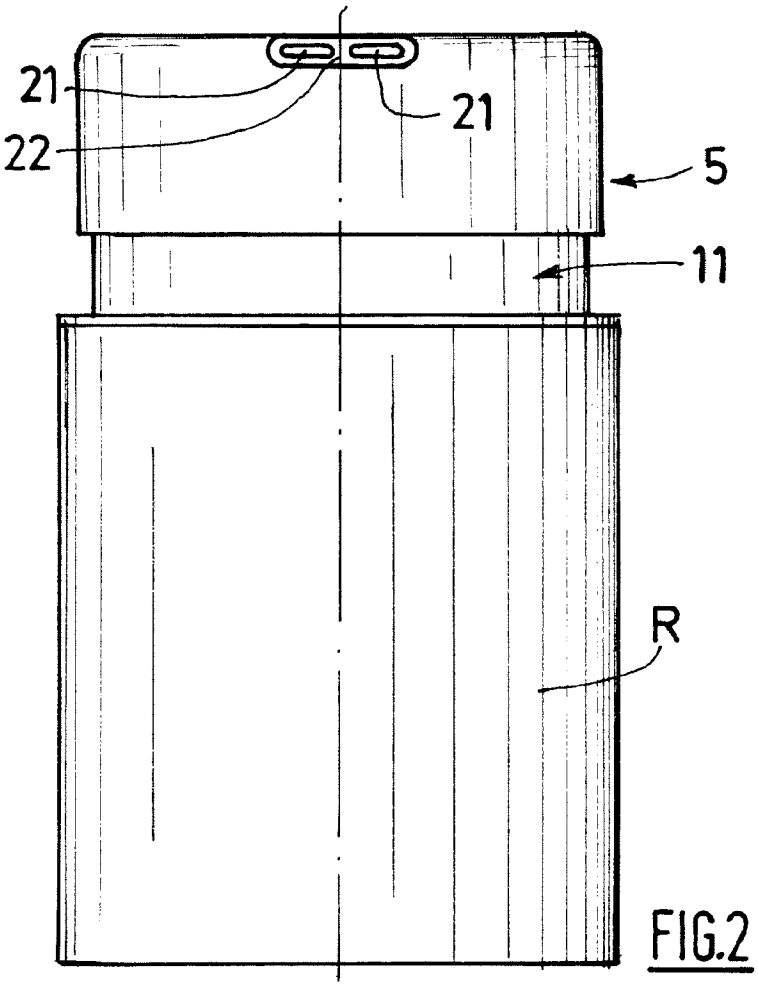
FIG. 2 shows an external front view of the dispenser in FIG. 1.

The distributor shown in the figures comprises a container R equipped with several independent compartments and, in this case, with two semicylindrical compartments r1, r2, each associated with a pump P1, P2.

Each compartment/pump assembly is adapted for a specific component of a final product to be supplied in the form of a mix or as different products (references 1 and 2 in the figures).

The pumps P1, P2 usually consist of a body, which is blocked, at the bottom, by a suction valve 10 and, at the top, by an applicator 2 and/or an exhaust valve 20. The bodies 1 contain piston mechanisms 3 which cooperate with at least one elastic return system 4.

In the embodiments of the invention as shown in FIGS. 1 to 4, the pump bodies 1 are solidly attached to one another in the form of a single shrunk-on ring 11 by a linking spacer 12 which also covers the compartments r1, r2 of the container R in a watertight manner.

The bodies 1 generally have a tapered cylinder shape with a flared top opening which receives the piston mechanism 3.

Applicators 2 are fixed under at least one cover 5 forming an actuator which cooperates with the return system 4.

They are fixed by locking the top of the applicators 2 in a rim 50 of the cover equipped with a peripheral ridge 51.

Figure 1:
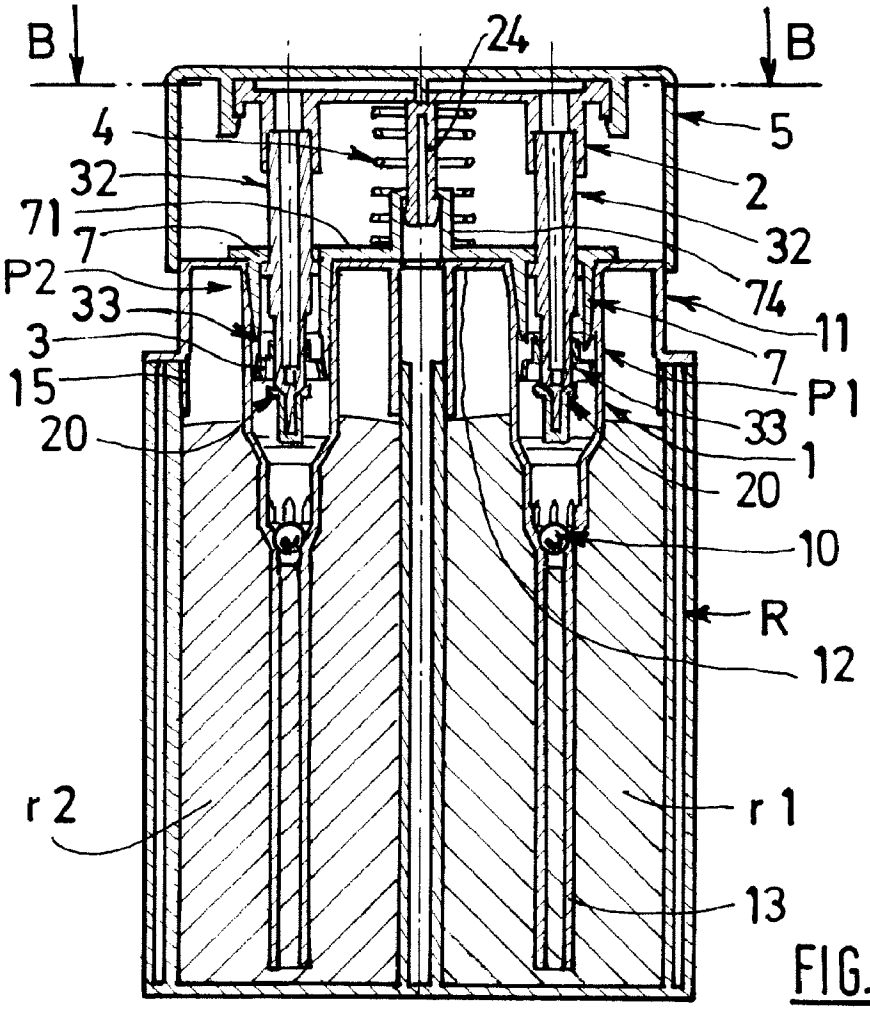
FIG. 1 shows a vertical cross-section view of a first embodiment of the dispenser according to the invention.

The pump mechanism, in the embodiment of FIG. 1, consists of a piston in the form of a hollow rod 32 covered at the top by an applicator 2 and coupled, at the bottom, with an inverted cup 33.

This coupling allows a slight displacement of the rod 32 in relation to the cup 33.

The cup 33 is designed to slide in contact with the inner wall of the body 1 by the action of the actuator 5 in order to compress the product in the bottom chamber 30 and expel it, when the rod 32 is at the bottom end of its stroke, via the exhaust valve arranged at the bottom of said rod.

The top watertightness is provided in this case by a bush 7 inserted in the body 1 around the rod 32 and solidly attached to the bushes associated with other pumps by means of a plate 71 supporting a central sleeve 74 for blocking the return system 4.

It is, however, possible to provide, in a variation not shown, for the plate 71 to be equipped with a central bore through which the central blocking sleeve passes, supported in this case by the spacer 12.

Figure 4:
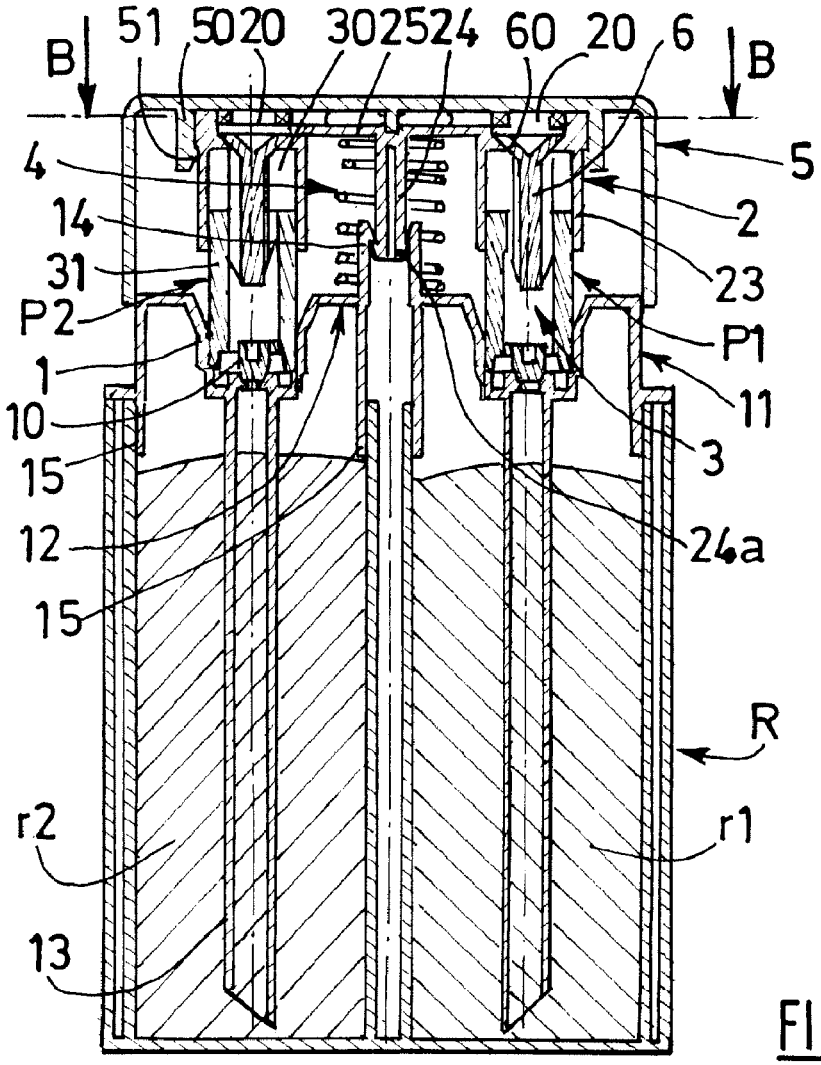
FIG. 4 shows a vertical cross-section of a first alternative embodiment of the dispenser according to the invention.

In the embodiment of FIG. 4, the piston 3 is in the form of an inner jacket 31, anchored on the inside of the bottom of the body 1 and supporting the suction valve 10.

In this case, the applicator 2 comprises a lateral skirt 23 which slidingly covers the piston 3 by producing a compression effect in the top chamber 30, with an axial rod 6 passing through it, the conical top end 60 of which forms the valve of the exhaust valve 20.

In this case, the spacer 12 supports a central sleeve 14 for blocking the return system 4.

In a general manner, the pump bodies are made from a single piece with intake tubes 13 immersed at least partially in the product inside the respective compartments r1, r2 of the container R.

The return system 4 is implemented in the form of a single spring 4 mounted outside the bodies and not in contact with the product components. The spacer 12 is equipped with at least one return element 15 watertight with the wall of the compartments r1, r2.

In the embodiment shown in FIGS. 1 and 4, the return elements 15 are arranged in a radial clamp both against the central dividing wall between the two compartments and on the inner perimeter of the side walls of said compartments.

Figure 7:
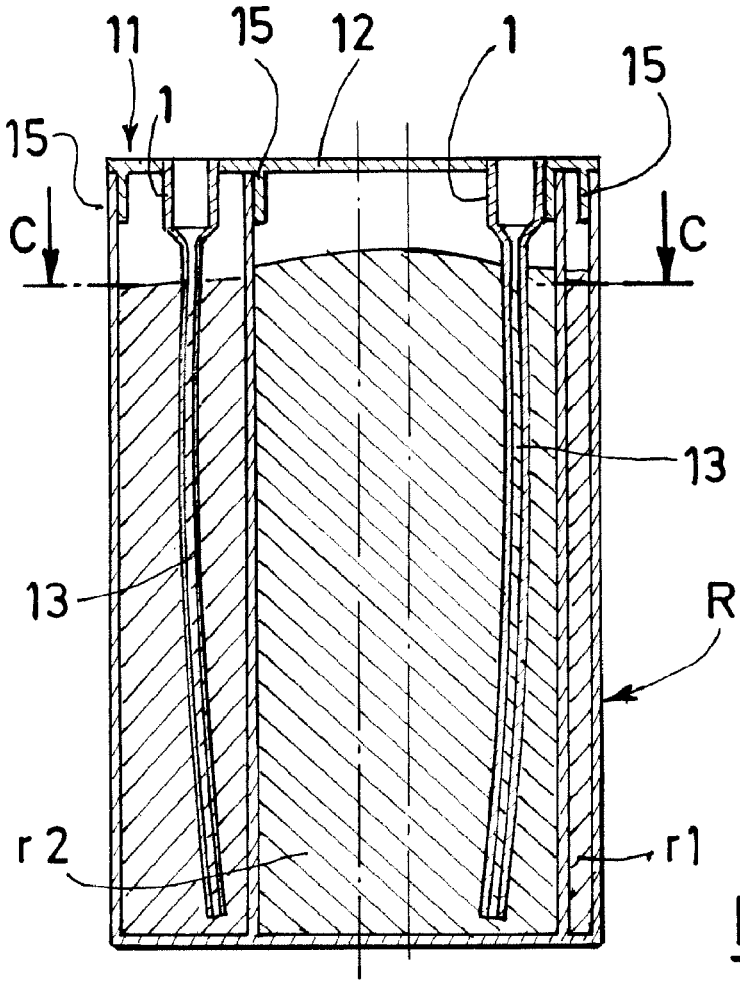
FIGS. 7 and 8 show a vertical cross-section and partial transversal cross-section along the C-C axis, respectively, of a third alternative embodiment of the dispenser according to the invention.
Figure 8:
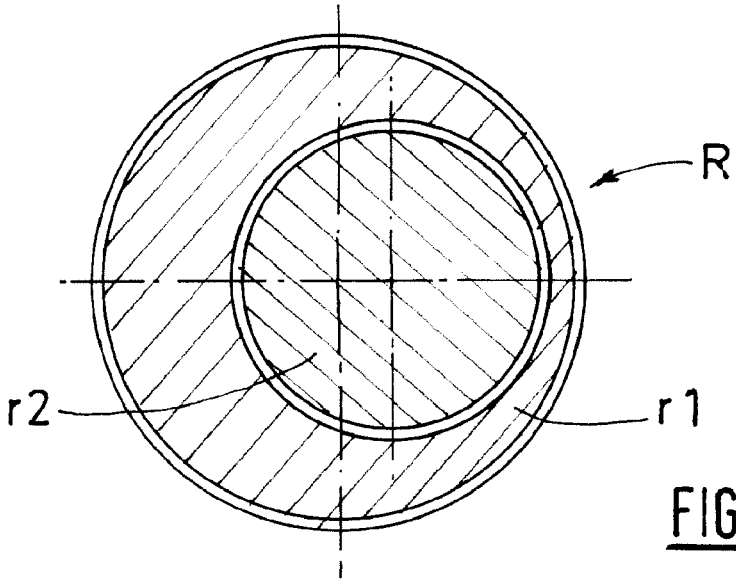

In order to minimise bulk, the compartments are preferably cylindrical and arranged within one another in a nested manner as shown in FIGS. 7 and 8.

In this case, the shrunk-on ring 11 is potentially asymmetric.

Figure 3:
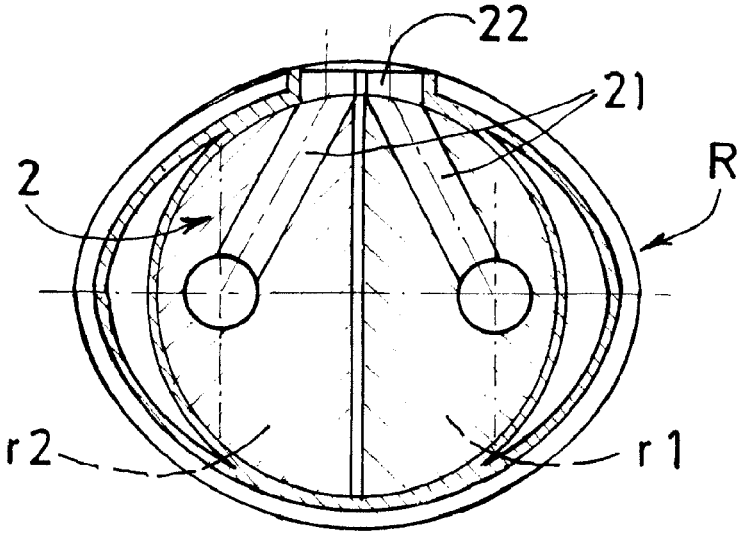
FIG. 3 shows a horizontal cross-section along the BB axis of the dispenser in FIG. 1.

As shown in FIG. 3, the top side of the applicators 2 comprises a radial groove 21 opening onto the outside via a discharge passage 22 which is shared by the pumps P1, P2.

The grooves 21 are watertightly sealed at the top part by the bottom side of the cover 5.

The applicators 2 also have radial shoulders 25 supported by the single return system 4 and supporting a centering finger 24 of said system. The finger 24 extends axially in the sleeve 14 of the shrunk-on ring 11 (FIG. 4) or in the sleeve 74 of the plate 71 (FIG. 1) where it is guided in a potentially sliding manner and retained at the top by its bottom end which has a hook 24*a*.

In the embodiment shown in FIGS. 1 and 4, the shoulders 25 are connected in a central manner forming a single cylinder which is solidly attached to all the pumps.

Figure 6:
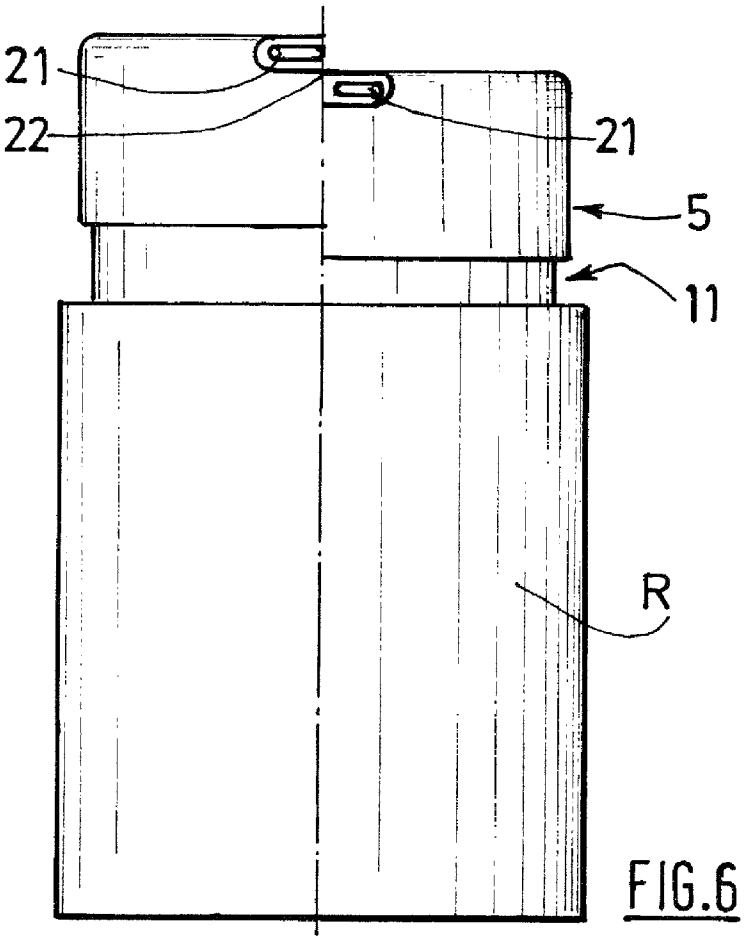
FIGS. 5 and 6 show a vertical cross-section and an external elevation, respectively, of a second alternative embodiment of the dispenser according to the invention.
Figure 5:
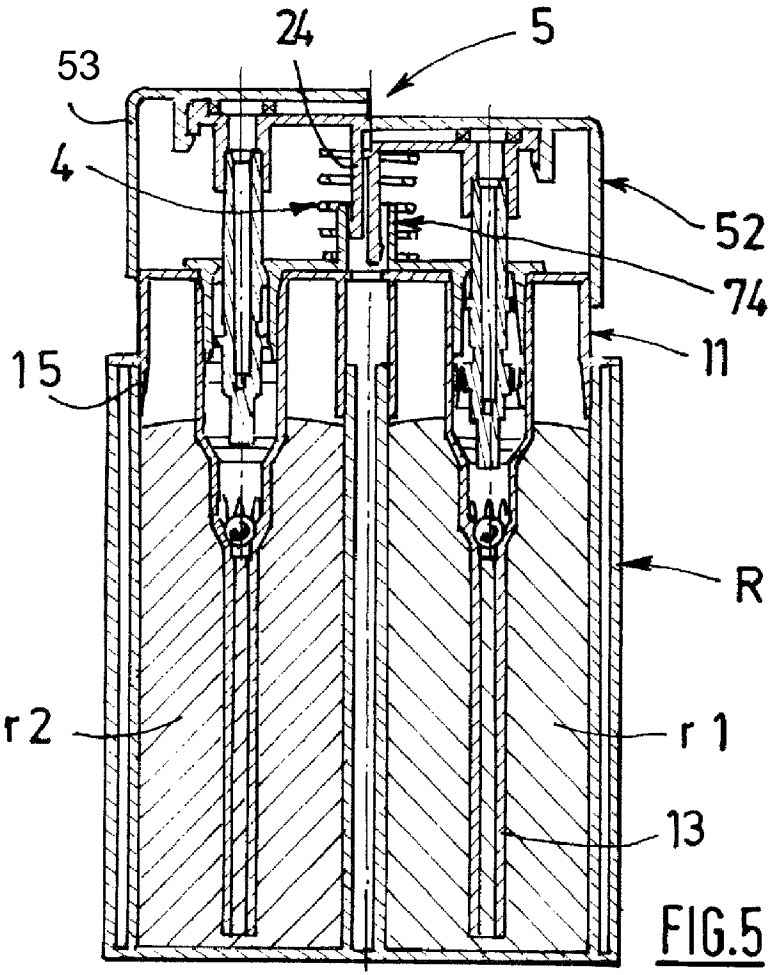

In a variation shown in FIGS. 5 and 6, the cover 5 is divided in several, in this case two, juxtaposed buttons 52, 53 each of which can act on its own as an actuator on the single return system 4 to selectively activate one of the pumps.

In this case, the finger 24 consists of several contiguous parallel sections which can be displaced axially and independently from one another at the center of the system 4 and in the sleeve 74 (or 14 in FIG. 4).

However, the discharge passage 22 in this case consists of several cavities with complementary profiles into which the respective grooves of the applicators open.

The overall aesthetic appearance is nearly identical to that of the variants with a single-piece actuator.

Furthermore, it is not necessary for the other structural and functional elements of the dispenser according to the invention to be modified in relation to the previously described embodiments.

What is claimed:

1. Liquid product dispenser comprising a container equipped with several independent compartments, each of which is associated with a pump consisting of a body which is blocked, at the bottom, by a suction valve and, at the top, by an applicator and an exhaust valve and which contains a piston mechanism cooperating with an elastic return system, characterised in that said pump bodies are formed together as a single unitary piece in the form of a single shrunk-on ring including a linking spacer formed integrally between said pump bodies, wherein the single shrunk-on ring also watertightly covers said container compartments;

characterised in that said linking spacer has a central sleeve for blocking the elastic return system;

characterised in that said applicators have radial shoulders supported by the elastic return system, said radial shoulders supporting a centering finger of the elastic return system, the centering finger extending axially and in a sliding manner in the central sleeve.

2. Dispenser according to claim 1, characterised in that said shrunk-on ring comprises at least one element for watertight connection with the wall of the compartments.

3. Dispenser according to claim 1, characterised in that said applicators are fixed to a cover forming at least one actuator which cooperates with the return system.

4. Dispenser according to claim 1, characterised in that the top side of said applicators comprises a radial groove which opens to the outside via a discharge passage.

5. Dispenser according to claim 3, characterised in that a groove is closed at the top by the bottom side of said cover.

6. Dispenser according to claim 1, characterised in that said shoulders are connected in a central manner forming a single cylinder.

7. Dispenser according to claim 1, characterised in that said compartments are cylindrical and arranged within one another in a nested manner.

8. Dispenser according to claim 1, characterised in that said pump bodies include intake tubes immersed in said container compartments.

9. Dispenser according to claim 1, characterised in that said applicators comprise a lateral skirt slidingly covering the piston, the piston consisting of an inner jacket anchored in the body of the pump and supporting the suction valve.

10. Dispenser according to claim 9, characterised in that said jacket has an axial rod passing through it, the top end of which forms the valve of the exhaust valve.

11. Dispenser according to claim 1, characterised in that said piston consists of a hollow rod covered, at the top, by said applicator and coupled, at its lower part, with an inverted cup.

12. Dispenser according to claim 11, characterised in that said rod is mobile in relation to said cup so as to open the exhaust valve arranged at the bottom end of said rod.

13. Dispenser according to claim 11, characterised in that said pumps are blocked in a watertight manner by bushes inserted in the body around the hollow rods, which are solidly attached to one another by means of a plate.

14. Dispenser according to claim 2, wherein said applicators are fixed to a cover forming at least one actuator which cooperates with the return system.

15. Dispenser according to claim 4, wherein said groove is closed at the top by the bottom side of said cover.

16. Dispenser according to claim 1, wherein said shoulders are connected in a central manner forming a single cylinder.

17. Dispenser according to claim 12, wherein said pumps are blocked in a watertight manner by bushes inserted in the body around the hollow rods, which are solidly attached to one another by means of a plate.

* * * * *